US008844417B2

(12) United States Patent
Koch et al.

(10) Patent No.: US 8,844,417 B2
(45) Date of Patent: Sep. 30, 2014

(54) CUTTING MACHINE FOR FOOD

(75) Inventors: Nikolaus Koch, Geislingen (DE); Timo Capone, Balingen (DE)

(73) Assignee: Bizerba GmbH & Co. KG, Balingen (DE)

( * ) Notice: Subject to any disclaimer, the term of this patent is extended or adjusted under 35 U.S.C. 154(b) by 286 days.

(21) Appl. No.: 13/387,126

(22) PCT Filed: Aug. 4, 2010

(86) PCT No.: PCT/EP2010/004768

§ 371 (c)(1),
(2), (4) Date: Jan. 26, 2012

(87) PCT Pub. No.: WO2011/018177

PCT Pub. Date: Feb. 17, 2011

(65) Prior Publication Data

US 2012/0137850 A1 Jun. 7, 2012

(30) Foreign Application Priority Data

Aug. 8, 2009 (DE) ..... 10 2009 036 774

(51) Int. Cl.

| | |
|---|---|
| ***B26D 7/00*** | (2006.01) |
| ***B26D 7/06*** | (2006.01) |
| *B26D 1/00* | (2006.01) |
| *B26D 7/20* | (2006.01) |

(52) U.S. Cl.

CPC ..... *B26D 7/00* (2013.01); *B26D 7/0616* (2013.01); *B26D 2210/02* (2013.01); *B26D 2001/002* (2013.01); *B26D 2007/0025* (2013.01); *B26D 7/20* (2013.01)

USPC ..... 83/435.11; 83/435.15; 83/435.21; 83/859

(58) Field of Classification Search

USPC ..... 83/859, 932, 714, 717, 435.11, 435.15, 83/435.21; 205/324, 333; 427/299, 290, 427/379

See application file for complete search history.

(56) References Cited

U.S. PATENT DOCUMENTS

| | | | | |
|---|---|---|---|---|
| 3,511,690 | A | 5/1970 | Aharoni | |
| 4,180,609 | A | 12/1979 | Vassiliou | |
| 5,196,471 | A | 3/1993 | Rangaswamy et al. | |
| 5,228,372 | A * | 7/1993 | Harrop et al. | 83/13 |
| 6,291,054 | B1 | 9/2001 | Thomas et al. | |
| 6,415,697 | B1 * | 7/2002 | Brash et al. | 83/13 |
| 2003/0079589 | A1 * | 5/2003 | Kovacs | 83/42 |
| 2004/0115477 | A1 | 6/2004 | Nesbitt | |

(Continued)

FOREIGN PATENT DOCUMENTS

| | | | |
|---|---|---|---|
| CA | 1322747 | C | 10/1993 |
| CN | 101048277 | A | 10/2007 |

(Continued)

OTHER PUBLICATIONS

German Patent Office, Search Report in German Patent Application: No. DE 10 2009 036 771.8 (Aug. 31, 2010).

(Continued)

*Primary Examiner* — Omar Flores Sanchez
(74) *Attorney, Agent, or Firm* — Leydig, Voit & Mayer, Ltd.

(57) ABSTRACT

A cutting machine for food includes a machine housing having a surface with a coating including an oxide ceramic material and polytetrafluoroethylene. A drive motor is disposed in the machine housing and a cutting blade is driven by the drive motor.

19 Claims, 4 Drawing Sheets

(56) References Cited

U.S. PATENT DOCUMENTS

| | | | | |
|---|---|---|---|---|
| 2004/0224856 | A1 | 11/2004 | Saiki et al. | |
| 2005/0000346 | A1 | 1/2005 | Hartley et al. | |
| 2005/0115378 | A1* | 6/2005 | Kuchler | 83/707 |
| 2005/0115840 | A1 | 6/2005 | Dolan | |
| 2005/0132854 | A1* | 6/2005 | Kovacs | 83/13 |
| 2007/0044627 | A1* | 3/2007 | Clem et al. | 83/717 |
| 2009/0007814 | A1 | 1/2009 | Lancsek et al. | |
| 2009/0108240 | A1 | 4/2009 | Gimvang | |
| 2010/0216929 | A1 | 8/2010 | Jung et al. | |

FOREIGN PATENT DOCUMENTS

| | | | |
|---|---|---|---|
| DE | 1920523 | A1 | 11/1970 |
| DE | 2631036 | A1 | 1/1977 |
| DE | 3736292 | A1 | 5/1989 |
| DE | 4002717 | A1 | 8/1991 |
| DE | 9318931 | U1 | 4/1994 |
| DE | 69014877 | T2 | 4/1995 |
| DE | 69110416 | T2 | 10/1995 |
| DE | 19514432 | A1 | 10/1996 |
| DE | 29824258 | U1 | 6/2001 |
| DE | 10014486 | A1 | 10/2001 |
| DE | 69901530 | T2 | 11/2002 |
| DE | 10134559 | A1 | 2/2003 |
| EP | 0510546 | A1 | 10/1992 |
| EP | 1469050 | A1 | 10/2004 |
| GB | 2232672 | A | 12/1990 |
| JP | 53065173 | A | 6/1978 |
| JP | 2007316574 | A | 12/2007 |
| WO | WO 2004/055229 | A2 | 7/2004 |
| WO | WO 2007/109817 | A2 | 10/2007 |
| WO | WO 2009/055020 | A1 | 4/2009 |
| WO | WO 2009/072738 | A1 | 6/2009 |

OTHER PUBLICATIONS

European Patent Office, International Search Report in International Patent Application No. PCT/EP2010/004768 (Dec. 22, 2010).

* cited by examiner

CUTTING MACHINE FOR FOOD

CROSS-REFERENCE TO RELATED APPLICATIONS

This application is a U.S. National Phase application under 35 U.S.C. §371 of International Application No. PCT/EP2010/004768, filed on Aug. 4, 2010, and claims benefit to German Patent Application No. DE 10 2009 036 774.8, filed on Aug. 8, 2009. The International Application was published in German on Feb. 17, 2011 as WO 2011/018177 A1 under PCT Article 21 (2).

FIELD

The invention relates to a cutting machine for food

BACKGROUND

In practice, cutting machines for food are generally used to cut up food such as meat, sausage, cheese or fish. This necessitates high hygiene requirements and good cleaning options.

US 2005/0000346 A1 describes a cutting machine which is lacquered with a bacteria-inhibiting clear lacquer. However, a clear lacquer of this type has poor resistance against mechanical loads and can become detached.

It is further known to coat cutting tools with polytetrafluoroethylene. For example, DE 298 24 258 U1 describes a cutting blade comprising a coating of this type. However, a polytetrafluoroethylene coating of this type also has the drawback of not being very wear-resistant.

SUMMARY

In an embodiment, the present invention provides a cutting machine for food including a machine housing having a surface with a coating including an oxide ceramic material and polytetrafluoroethylene. A drive motor is disposed in the machine housing and a cutting blade is driven by the drive motor.

BRIEF DESCRIPTION OF THE DRAWINGS

Exemplary embodiments of the present invention are described in more detail below with reference to the drawings, in which.

DETAILED DESCRIPTION

Figure 1:
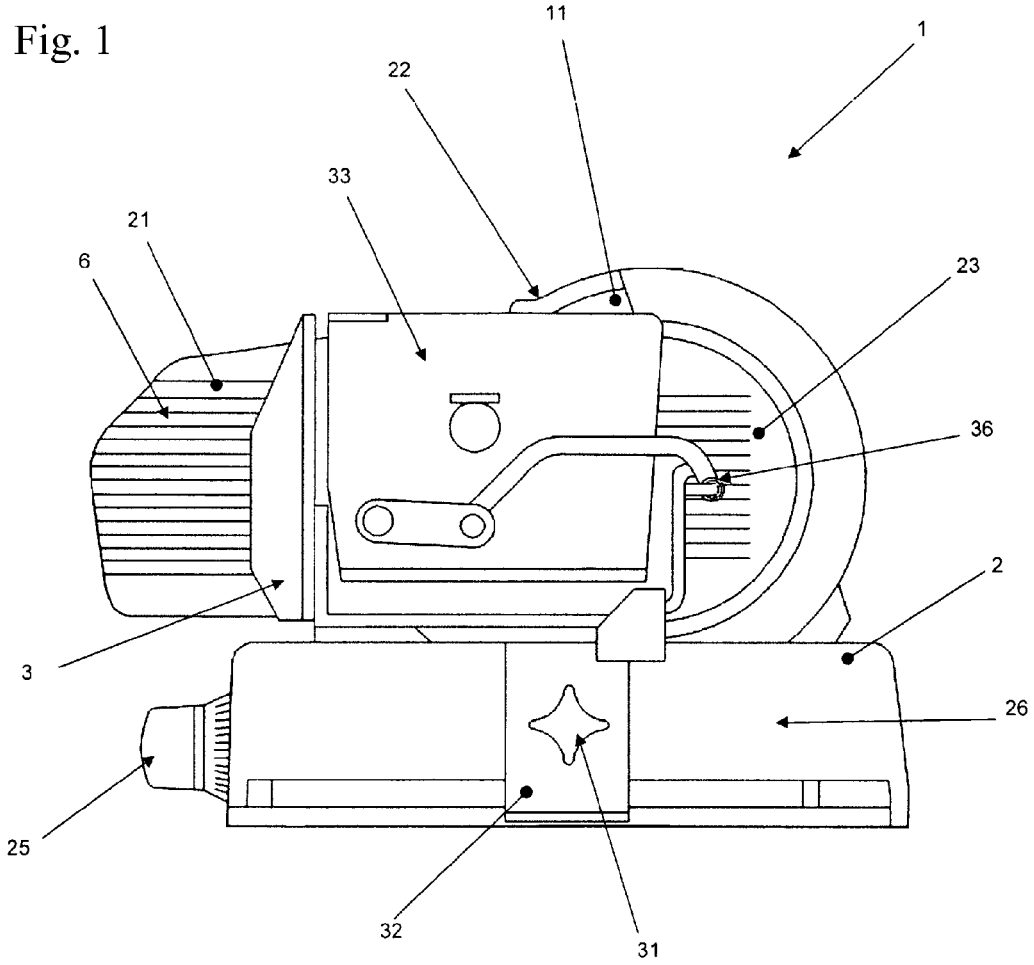
FIG. 1 is a side view of a cutting machine.

In an embodiment, the present invention provides a cutting machine having an appealing design combined with high mechanical resistance. In particular, the cutting machine can have a high wear-resistance.

The cutting machine comprises a housing having a surface coating. This coating comprises a mixture of oxide ceramic material and polytetrafluoroethylene as constituents. It has been found that this mixture improves the wear-resistance of the coating, and at the same time, the good sliding properties and chemical resistance of polytetrafluoroethylene are maintained. In this context, it is advantageous that the mixture of oxide ceramic material and polytetrafluoroethylene forms a solid matrix after setting. In this context, the coating is preferably set in a drying or baking process at defined temperatures. This matrix, resulting from the drying or baking process, of the composite material, newly resulting from the mixture, is very durable, wear-resistant, and extremely chemically resistant. In addition, this mixture does not comprise any toxic substances, and can therefore be used in the food-processing industry.

Further constituents such as coloured pigments can additionally be incorporated into the matrix. This makes it possible to colour the cutting machine in a particularly mechanically resistant and above all food-safe manner. To improve the adhesion of the mixture, the surface of the part to be coated, preferably the machine housing, may also be provided with a primer or adhesion promoter.

It is provided that the coating can comprise a binder so as to form a stable matrix for the oxide ceramic material and the polytetrafluoroethylene. Epoxy-based or polymer-based resins or silicones have been found to be particularly adapted as binders. For particularly good mechanical resistance, a binder consisting of a polyether ketone can also be used, although this has a relatively high price and is thus disadvantageous in terms of cost.

To achieve good adhesion and scratch-resistance of the coating, it has been found to be advantageous if the oxide ceramic material comprises particles of aluminium oxide $Al_2O_3$ and preferably at least one further metal oxide, in particular titanium oxide $TiO_2$ and/or magnesium oxide MgO. In particular, photocatalytically active titanium oxide is advantageous, since it has a self-cleaning effect via the reaction with UV light and thus provides a hygienic surface of the cutting machine.

The cutting machine comprises in particular a machine housing which mounts a drive motor for a round cutting blade which is driven in rotation. The cutting blade is formed separately from the machine housing and removably mounted on a drive hub of the drive motor. The housing further comprises a movable slide and an adjustable stop plate and safety devices such as a blade cover and a blade guard.

It is provided that in particular one or more of the surfaces of the machine housing which are in direct contact with the foods are coated. Thus, the stop plate and/or the slide and/or a blade protective cover or blade guard are provided with the coating. In this context, above all the polytetrafluoroethylene, which acts as dry lubricant, has a positive effect, since it prevents adhesion of foods to the surfaces and thus reduces the friction thereof and also improves the cleaning of the surfaces. Coating of the cutting blade or the surface thereof is not provided, since the cutting blade has to be sharpened frequently and the coating can interfere with this.

The slide, along with a food delivery device, is fixed to the machine housing via slide bearings. In this context, a slide bush or a slide pin is guided over a sliding surface. It has been found to be advantageous if a sliding surface of the slide bearing is provided with the coating. This decreases the friction of the sliding surface and simultaneously improves the durability thereof. The surface of the sliding surface and/or the surface of the slide bush or the slide pin may be provided with the coating.

To improve the wear-resistance of the slide bearing coating, it can be provided that the coating of a sliding surface has a higher oxide ceramic material proportion than the coating of a housing surface. To reduce the adhesion of foods to a housing surface, it can be provided that the coating of the housing surface has a higher proportion of polytetrafluoroethylene than the coating of a sliding surface.

For a particularly hygienic surface, it can be provided that the coating comprises a bacteria-inhibiting substance, preferably triclosan, as a further constituent.

A particularly visually appealing design can be achieved by mixing coloured pigments into the coating, so as to form a coloured surface which can be designed as desired.

For processing the coating, it is advantageous if the coating is applied as a lacquer by adding a solvent to the coating. The lacquer can thus be applied to the surfaces conventionally by spraying or dipping. To achieve particularly good adhesion of the coating or lacquer, a primer comprising an adhesion promoter or filler can be applied between the surface and the lacquer. In addition, the surface can be roughened before lacquering, for example by sandblasting, to improve the adhesion.

In particular, various surfaces can be adapted using a primer, and thus both metal surfaces and plastics material surfaces can be provided with the coating. Preferably, metal surfaces of the machine housing or of accessories or attachments which are made of metal, in particular aluminium, iron or steel, or of plastics material can be coated.

The applied lacquer is dried in two steps. In a first drying process, the solvent of the lacquer is removed at a relatively low temperature. A temperature range of approximately 40° Celsius to 90° Celsius is best adapted for this purpose. Subsequently, the coating is baked or sintered in a second step at a higher temperature. In this case a temperature in the range of 120° Celsius to a maximum of 450° Celsius is set, depending on the binder used and the surface.

It is in particular provided to use the coating for the surfaces of automatic or manual cutting machines which are subjected to high mechanical or chemical stress such as generally results from frequent cleaning or disinfection of the cutting machines.

Figure 2:
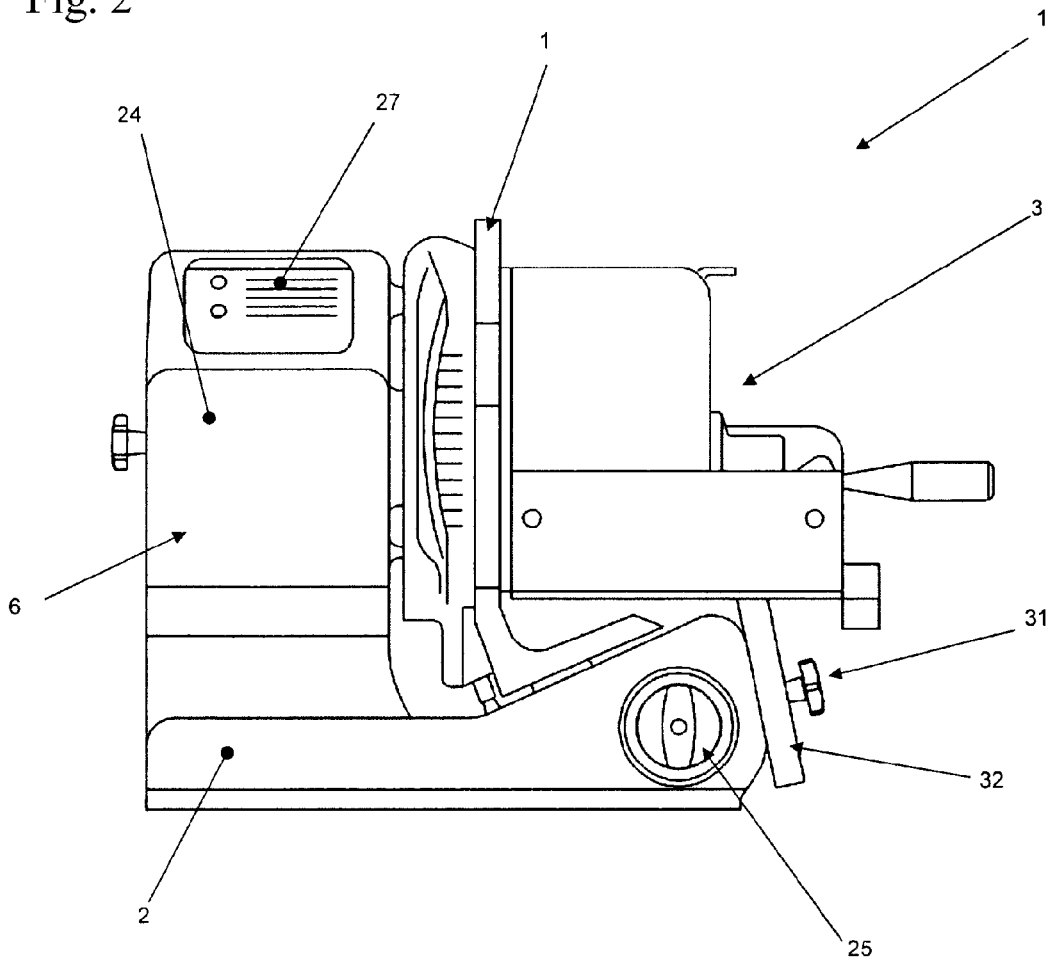
FIG. 2 is a front view of the cutting machine.
Figure 3:
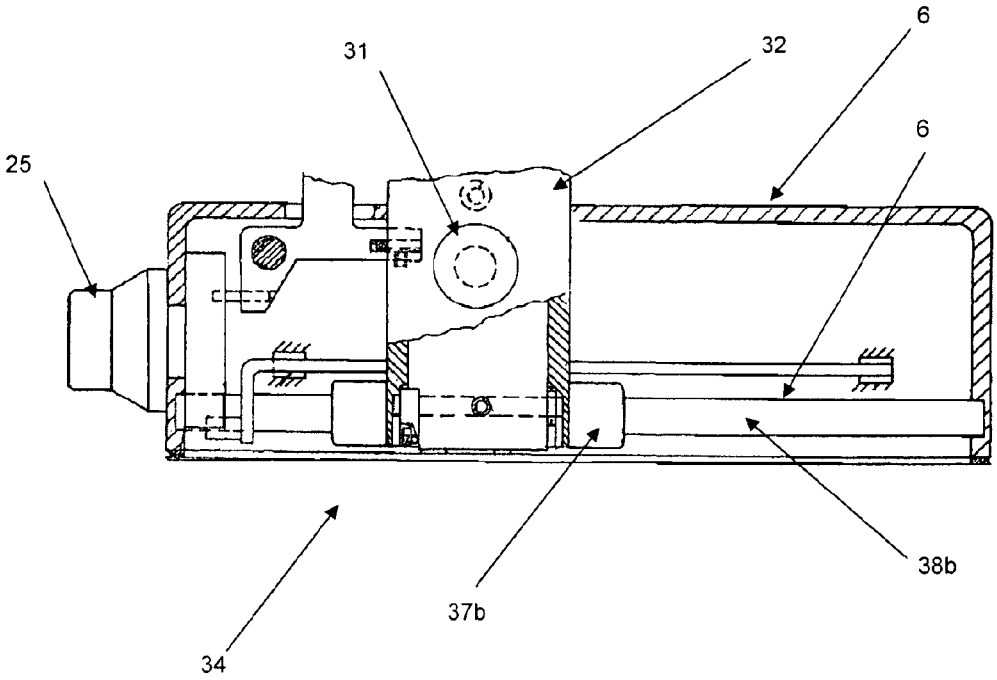
FIG. 3 is a detail of the slide bearing of the slide.

FIGS. 1 and 2 show a cutting machine 1 for food comprising a motor-driven cutting blade 11. The cutting blade 11 is mounted on a machine housing 2 and has a vertical cutting plane. However, in one configuration of the cutting machine, the cutting plane of the cutting blade 11 may also be at an inclination to the vertical (not shown). The motor for the cutting blade 11 is accommodated entirely within a motor tower 24 of the machine housing 2. The machine housing 2 further comprises a slide 3, which is movably mounted via a slide bearing 34 shown in FIG. 3, and a stop plate 21, as well as blade protection devices such as a blade cover 23 and a blade guard 22. The cutting machine 1 can be operated via an operating terminal 27 attached at the top of the motor tower 24.

The slide bearing 34 comprises a slide bush 37*b*, which slides on a slide rail 38*b*. The slide bush 37*b* is made of a plastics material, for example polyoxymethylene (POM), and connected to a slide arm which carries the slide 3. The slide rail 38*b* is made of steel and is rigidly connected to the machine housing 2. The surfaces of the machine housing and the slide rail 38*b* are provided with a coating 6, the constituents of which are oxide ceramic material and polytetrafluoroethylene.

The slide 3 is detachably connected to the slide bearing 34 via a slide arm 32. Via a slide lock 31, the slide 3 can be unlocked and removed, for example for cleaning or maintenance purposes.

Figure 4:
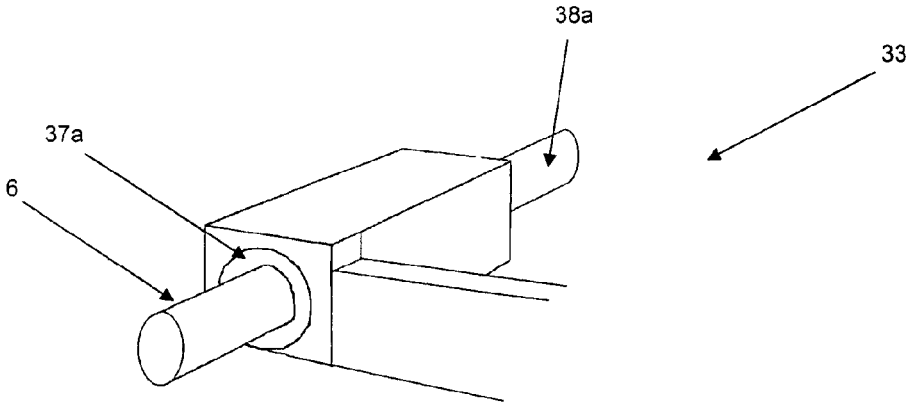
FIG. 4 is a detail of the slide bearing of the delivery device.

The stop plate 21 is arranged before the cutting blade in the cutting plane and is movable parallel to the cutting plane, in such a way that the slice thickness of the food slices cut off by the cutting blade 11 can be adjusted using a slice thickness adjuster 25. For cutting, the foods are laid on the slide 3, where they are held by a delivery device 33, and delivered to the cutting plane. For this purpose, the delivery device 33 is movably mounted on the slide 3 by means of a slide bearing 36, shown in FIG. 4.

The slide bearing 36 comprises a slide bush 37*a*, which is connected to the delivery device and slides on a slide rail 38*a* which is rigidly connected to the slide. The slide bush 37*a* may also have an internal thread, which interlocks with a thread of the slide rail 38*a* and thus forms a screw drive. The surface of the slide rail comprises a coating 6, the constituents of which are oxide ceramic material and polytetrafluoroethylene.

Figure 5:
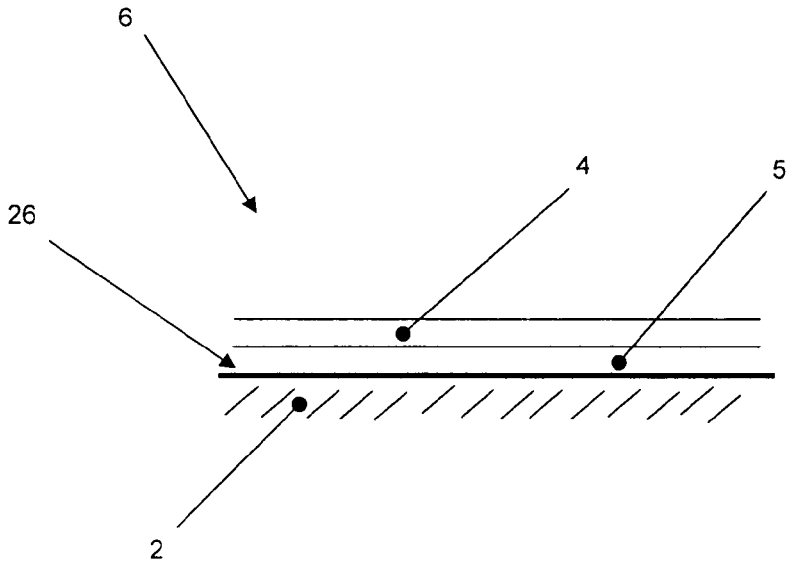
FIG. 5 is a schematic drawing of the coating.

The surfaces of the slide 3 or the stop plate 21 and of the blade cover 23 are in direct contact with the foods to be cut. Hygiene and good cleaning options are particularly important for these surfaces. However, the housing surface 26 should also be mechanically resistant and easy to clean. These housings therefore comprise a coating 6 having a structure as shown in FIG. 5.

The machine housing 2 has a surface 26 which is provided with the coating 6. The coating 6 comprises two different layers. A primer 5 is applied to the housing surface 26 as the first layer. The primer acts as an adhesion promoter and provides good bonding of the lacquer 4 to the housing surface 26.

As components, the lacquer 4 comprises oxide ceramic material consisting of aluminium oxide and polytetrafluoroethylene, which are arranged in a matrix as small particles along with a binder. A volatile solvent keeps the unprocessed lacquer in liquid form and provides easy processing by spraying or dip-lacquering.

While the invention has been particularly shown and described with reference to preferred embodiments thereof, it will be understood by those skilled in the art that various changes in form and details may be made therein without departing from the spirit and scope of the invention.

What is claimed is:

1. A cutting machine for food comprising:

a machine housing including a surface having a coating including a binder, an oxide ceramic material and polytetrafluoroethylene, wherein the binder forms a matrix for the oxide ceramic material and the polytetrafluoroethylene;

a drive motor disposed in the machine housing; and a cutting blade driven by the drive motor.

2. The cutting machine recited in claim 1, wherein the cutting machine is configured to cut strand-shaped foods.

3. The cutting machine recited in claim 1, wherein the binder includes at least one of epoxy resin, polymer resin, polyurethane and silicone.

4. The cutting machine recited in claim 1, wherein the oxide ceramic material includes particles of aluminum oxide.

5. The cutting machine recited in claim 4, wherein the oxide ceramic material includes a further metal oxide in addition to the aluminum oxide.

6. The cutting machine recited in claim 5, wherein the further metal oxide is titanium oxide or magnesium oxide.

7. The cutting machine recited in claim 1, wherein the machine housing includes a stop plate and a movably mounted slide, and wherein the coating is provided on a surface of at least one of the stop plate and slide.

8. The cutting machine recited in claim 1, further comprising a slide displaceabley mounted on the machine housing via a slide bearing having two cooperating sliding surfaces, wherein the coating is provided on at least one of the sliding surfaces.

9. The cutting machine recited in claim 1, wherein the housing includes a slide having a holding device, the holding device being displaceably mounted via a slide bearing having two cooperating sliding surfaces configured to hold a food strand, the coating being provided on at least one of the two cooperating sliding surfaces.

10. The cutting machine recited in claim 1, wherein the machine housing includes a slide bearing with a sliding surface having a coating, and wherein the coating of the sliding surface of the slide bearing has a higher oxide ceramic material content than the coating of the surface of the machine housing.

11. The cutting machine recited in claim 1, wherein the machine housing includes a slide bearing with a sliding surface having a coating, and wherein the coating of the sliding surface of the slide bearing has a higher polytetrafluoroethylene content than the coating of the surface of the machine housing.

12. The cutting machine recited in claim 1, wherein the coating includes a bacteria inhibitor.

13. The cutting machine recited in claim 12, wherein the bacteria inhibitor is triclosan.

14. The cutting machine recited in claim 1, wherein the coating includes a coloured pigment.

15. A method for manufacturing a cutting machine comprising:

providing a machine housing and a motor-driven cutting blade for cutting off slices of a strand-shaped food; and applying a coating to a surface of the machine housing, the coating comprising a binder, oxide ceramic material and polytetrafluoroethylene, wherein the binder forms a matrix for the oxide ceramic material and the polytetraflouroethylene.

16. The method recited in claim 15, wherein the coating is a lacquer, and further comprising applying a layer of an adhesion promoter or filler to the surface of the machine housing before applying the lacquer.

17. The method recited in claim 15, wherein the coating is a lacquer and further comprising sandblasting the surface of the machine housing before applying the lacquer.

18. The method recited in claim 16 further comprising sandblasting the surface of the machine housing before applying the adhesion promoter or filler.

19. The method recited in claim 15, wherein the coating is a lacquer, and further comprising drying the lacquer in two steps in a temperature-controlled method including a drying step at a relatively low temperature followed by a baking or sintering step at a higher temperature.

* * * * *